United States Patent [19]

Atkins

[11] 4,230,232

[45] Oct. 28, 1980

[54] BOTTLE WITH CLOSURE CAP

[75] Inventor: Herbert A. Atkins, Maidenhead, England

[73] Assignee: Beecham Group Limited, Great Britain

[21] Appl. No.: 21,711

[22] Filed: Mar. 19, 1979

[30] Foreign Application Priority Data

Mar. 18, 1978 [GB] United Kingdom ..... 10799/78

[51] Int. Cl.[3] ..... B65D 41/04

[52] U.S. Cl. ..... 215/330

[58] Field of Search ..... 215/330, 331, 216

[56] References Cited

U.S. PATENT DOCUMENTS

| | | | |
|---|---|---|---|
| 2,684,168 | 7/1954 | McGinnis | 215/330 |
| 3,471,052 | 10/1969 | Atkins | 215/295 |
| 3,581,926 | 6/1971 | Roder | 215/330 |
| 3,891,110 | 6/1975 | Gach | 215/216 |
| 3,910,463 | 10/1975 | Reese | 215/216 X |
| 4,093,096 | 6/1978 | Augros | 215/330 |

*Primary Examiner*—Donald F. Norton

*Attorney, Agent, or Firm*—Jacobs & Jacobs

[57] ABSTRACT

In a screw capped bottle, a protuberance (7) cooperates with a notch (9) in a notch-bearing member (10) so that as the cap is screwed on, the protuberance bears on the notch-bearing member and one or both deforms to accommodate the threading movement until the protuberance snaps into the notch to terminate the movement. When screwing the cap off, there is an initial resistance to movement while the protuberance and/or notch-bearing member deforms. The protuberance then snaps out of the notch and the cap may be removed.

4 Claims, 3 Drawing Figures

BOTTLE WITH CLOSURE CAP

This invention relates to a capped bottle wherein the cap screws onto a neck portion of the bottle and which has an arrangement for ensuring the positive alignment of the cap on the neck of the bottle.

Capped bottles of the kind which have a screw cap are very common. However in many cases, repeated screwing-on and unscrewing the cap weakens the seal formed by the cap, leading to loss of fluid or volatile contents. Furthermore in capped bottles having rotational asymmetry the tolerances of the screw cap are progressively altered with repeated screwing or unscrewing or with overtightening, making it impossible to align the cap neatly with the bottle. It would, therefore, be desirable to provide a capped bottle having built in safeguard against these consequences.

One screw capped bottle having some such safeguard is described in British Pat. No. 1,261,772 (German OLS No. 1,757,325). In that design, the hem of the skirt of the cap snaps into matching engagement with the shoulder of the bottle to prevent overtightening. However, the reliability of this mechanism is dependent, to some extent, on the quality of the materials from which the bottle and/or cap are constructed. If those materials are too elastic, the snaplock arrangement weakens.

This invention is based on a mechanism which is less dependent on materials' quality.

According to the present invention there is provided a capped bottle wherein the cap threads onto a neck portion of the bottle, and wherein a notch bearing member on the cap cooperates with a protuberance on the bottle, or vice versa, such that the protuberance bears on said member after the start of the threading movement of the cap onto the neck of the bottle, the protuberance and/or notch bearing member deforming to accommodate said threading movement until the protuberance snaps into the notch to terminate said movement, and out of the notch at the start of the threading movement of the cap off the neck of the bottle.

To prevent excessive deformation of the protuberance and/or notch bearing member, the protuberance should preferably begin to bear on said member only towards the end of the threading movement of the cap onto the neck of the bottle.

If desired, there may of course be more than one notch bearing member and more than one protuberance. For example, there may be one cooperating protuberance and one notch bearing member to one side of the neck of the bottle and another cooperating protuberance and notch bearing member to the other side of the neck.

This invention is especially useful in the case of capped bottles wherein the cap is of non-circular horizontal cross-section and aligns with a matching non-circular upper shoulder portion of the bottle. In such cases the bottle will normally have a neck of circular cross-section positioned on a shoulder portion of non-circular cross-section in head-and-shoulders relationship. The cap will then normally have a tubular socket part which screws onto the neck of the bottle and a skirt part enveloping the tubular part and conforming at the hem of the skirt with the cross-sectional shape of the shoulder. In this way the bottle shoulder and cap blend smoothly into a uniform outline when the cap is in position.

The protuberance may be formed as a ridge on the shoulder of the bottle to cooperate with a notch in a rib or web, formed inside the cap. Alternatively, the protuberance may be formed on the neck of the bottle and may cooperate with a notch formed in the threaded part of the cap, e.g. the tubular socket part referred to in the preceding paragraph.

The advantage of the cooperating protuberance and notch arrangement embodied in the present invention resides in its provision of a means of aligning the cap with the bottle rather exactly. Without such an arrangement, the constant screwing and unscrewing of the cap loosens the tolerances of the screw threads and allows the cap to be overtightened, possibly destroying the sealing effect of the cap. Moreover, the looser tolerances make it difficult to align the cap with the shoulder of the bottle in those cases where both are rotationally asymmetric. The locking effect of the protuberance in the notch effectively prevents both overtightening and misalignment, and provides a satisfyingly positive "snap" to reassure the user that he has fully sealed the bottle.

Further features and embodiments of the invention will now be described in detail in connection with the accompanying drawings wherein.

Figure 2:
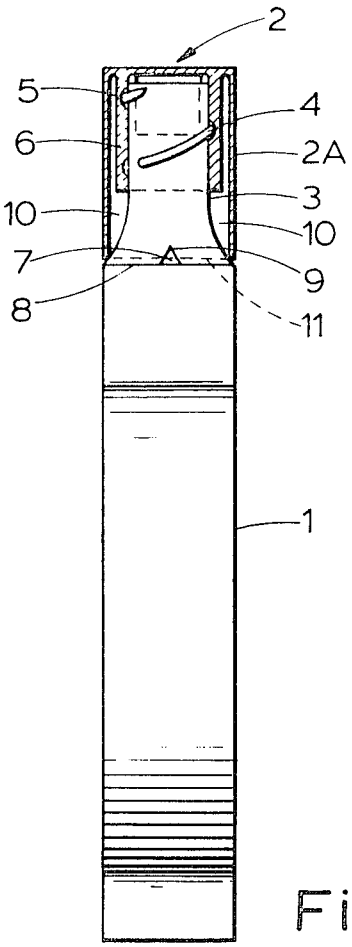
FIG. 2 is an axial cross-sectional side view of the capped bottle of FIG. 1.
Figure 1:
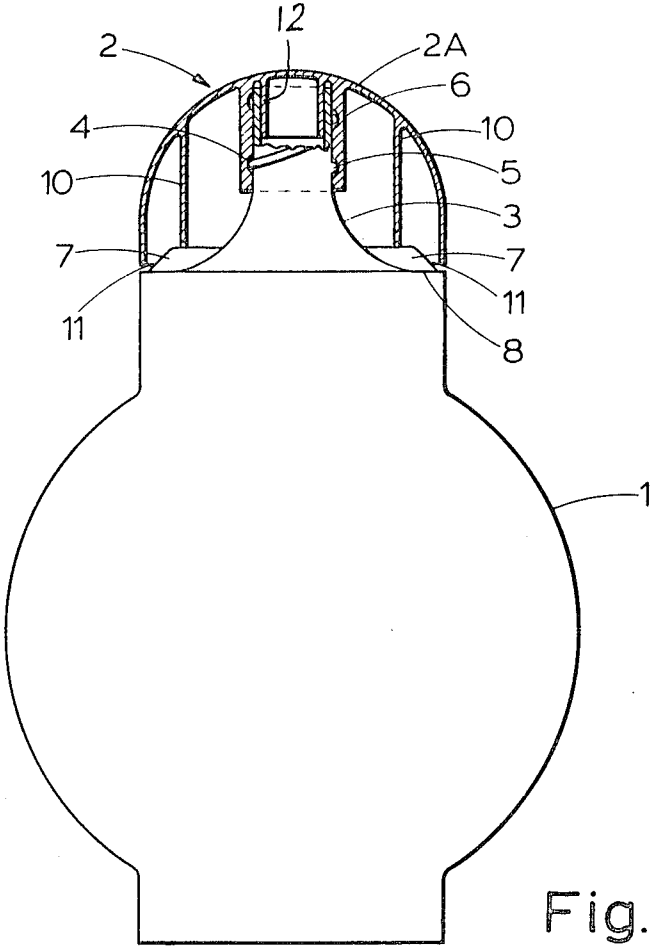
FIG. 1 is an axial cross-sectional front view of a capped bottle in accordance with this invention.
Figure 3:
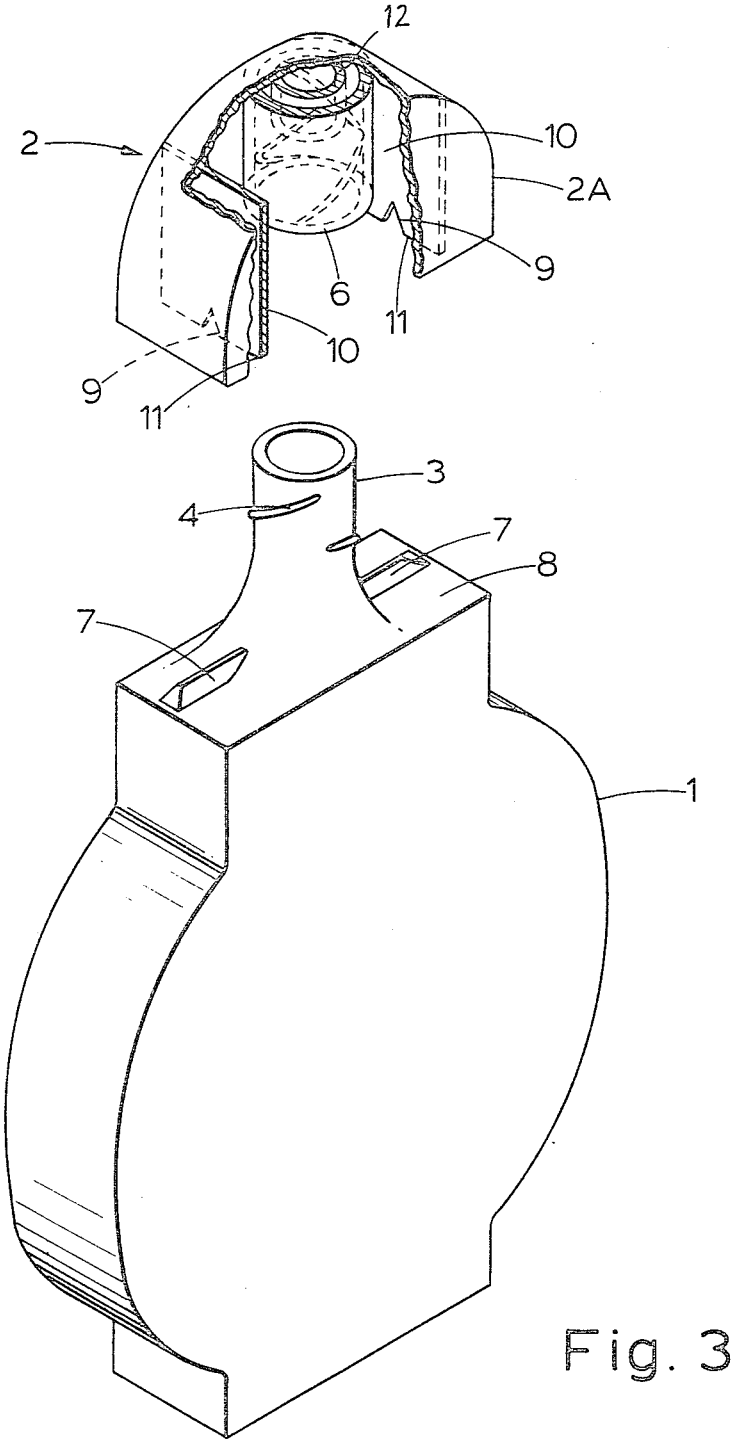
FIG. 3 is a perspective view of the capped bottle of FIGS. 1 and 2, with the cap removed and partially cut away.

Referring to the drawings a capped bottle in accordance with the invention comprises a bottle 1 with a cap 2 which screws onto a neck portion 3 of the bottle by means of outer threads 4 formed on the neck 3 and cooperating inner threads 5 formed on the inside of a tubular socket portion 6 of the cap. Protuberances 7 in the form of ridges of inverted V-shaped cross-section are formed on the shoulder 8 of the bottle 1. These protuberances engage matching notches 9 in notch bearing members (here provided by webs 10) located inside cap 2 when the cap is in position on the bottle (FIGS. 1 and 2).

In the embodiment of the invention shown in the drawings, the cap 2 is of non-circular horizontal cross-section. The tubular socket 6 which screws onto neck 3 is enveloped by a skirt portion 2A which at its hem is rectangular in plan. The shoulder 8 of the bottle 1 is likewise of rectangular plan and is of the same size as the hem of the skirt position of the cap. The protuberances 7 and notches 9 are positioned so that when they engage, the cap is exactly aligned with the shoulder 8 of the bottle. Moreover, the threads 4 and 5 are of such a pitch that as the cap is screwed onto the neck 3 the cap turns freely until almost in its position of final alignment with the shoulder 8, at which point the apexes of protuberances 7 begin to bear on the bottoms 11 of webs 10. Further turning of the cap deforms the bottoms 11 of webs 10 and, to a certain extent, the apexes of protuberance 10, until finally the protuberances snap into the notches 9 and terminate the screwing-on movement of the cap. At this point the cap is aligned with the shoulder of the bottle.

When the cap is to be removed from the neck, it is turned so that the bottoms 11 of webs 10 and, to a certain extent, the apexes of protuberances 7 are deformed, the notch tending to ride up the slopes of the protuberances. After passing a point of maximum resistance to turning, the cap suddenly becomes free to turn as the protuberances snap out of the notches.

It can be seen that the cooperation of the protuberances and notches of the invention serve to align the cap on the bottle and to prevent accidental over-tightening or accidental removal of the cap.

Since the notch bearing members 10 and/or the protuberances 7 must deform before release or engagement either one or the other or both should be formed from an elastically deformable material such as thermoplastics. Conveniently the entire bottle and cap assembly may be of thermoplastics. Alternatively the bottle and protuberances might be of glass and the cap of thermoplastics.

In the embodiment shown in the drawings, a plug 12 is provided in the cap 2, and is a friction fit into the neck 3 of the bottle. This provides further security against leakage of liquid or volatile contents in the event that the threads 4 and 5 are not enough. In another embodiment of the invention (not shown), the protuberance is on the neck portion and the notch is in the threaded part of the cap.

It is claimed:

1. A capped bottle which comprises a bottle having a threaded neck portion of circular horizontal cross-section positioned on a shoulder portion of non-circular horizontal cross-section in head-and-shoulders relationship, a cap threadedly engaging said neck portion, the cap having a tubular socket part which screws onto the neck of the bottle and a skirt part enveloping the tubular socket part and conforming at the hem of the skirt part with the horizontal cross-sectional shape of the shoulder, a notch bearing member on one of the cap and the bottle and a protuberance on the other of the cap and the bottle, said notch bearing member and said protuberance cooperating such that the protuberance bears on said member after the start of the threading movement of the cap onto the neck of the bottle, at least one of the protuberance and notch bearing member deforming to accommodate said threading movement until the protuberance snaps into the notch to terminate said movement, and out of the notch at the start of the threading movement of the cap off the neck of the bottle.

2. A capped bottle as claimed in claim 1 wherein the protuberance begins to bear on said member only towards the end of the threading movement of the cap onto the neck of the bottle.

3. A capped bottle as claimed in claim 1 wherein there is one cooperating protuberance and one notch bearing member to one side of the neck of the bottle and another cooperating protuberance and notch bearing member to the other side of the neck.

4. A capped bottle as claimed in claim 1 wherein the protuberance is formed as a ridge on a shoulder portion of the bottle to cooperate with a notch in a rib or web member formed inside the cap.

* * * * *